United States Patent [19]

Tomita et al.

[11] Patent Number: 4,950,336

[45] Date of Patent: Aug. 21, 1990

[54] METHOD OF PRODUCING NON-ORIENTED MAGNETIC STEEL HEAVY PLATE HAVING HIGH MAGNETIC FLUX DENSITY

[75] Inventors: Yukio Tomita; Ryota Yamaba; Yukio Tsuda; Katsuyoshi Yamanaka; Tatsuya Kumagai, all of Tokai, Japan

[73] Assignee: Nippon Steel Corporation, Tokyo, Japan

[21] Appl. No.: 368,031

[22] Filed: Jun. 19, 1989

[30] Foreign Application Priority Data

| | | | |
|---|---|---|---|
| Jun. 24, 1988 | [JP] | Japan | 63-154640 |
| Jun. 24, 1988 | [JP] | Japan | 63-154641 |
| Jun. 24, 1988 | [JP] | Japan | 63-154642 |
| Jun. 24, 1988 | [JP] | Japan | 63-154643 |
| Jun. 24, 1988 | [JP] | Japan | 63-154644 |
| Jun. 24, 1988 | [JP] | Japan | 63-154645 |
| Jun. 27, 1988 | [JP] | Japan | 63-156718 |
| Jun. 27, 1988 | [JP] | Japan | 63-156719 |
| Jun. 27, 1988 | [JP] | Japan | 63-156720 |
| Jun. 27, 1988 | [JP] | Japan | 63-156722 |

[51] Int. Cl.[5] ..... H01F 1/047

[52] U.S. Cl. ..... 148/111; 148/112

[58] Field of Search ..... 148/111, 112

[56] References Cited

U.S. PATENT DOCUMENTS 4,054,471 10/1977 Datta ..... 148/113

FOREIGN PATENT DOCUMENTS 60-96749 5/1985 Japan .

*Primary Examiner*—Melvyn J. Andrews

*Attorney, Agent, or Firm*—Kenyon & Kenyon

[57] ABSTRACT

A method of producing non-oriented magnetic steel heavy plate that has good magnetic properties in a low magnetic field that comprises hot-rolling high-purity steel, adjusting the crystal grain size and dehydrogenation treatment, whereby the a uniform ferrite grain diameter is imparted to the steel.

11 Claims, 4 Drawing Sheets

METHOD OF PRODUCING NON-ORIENTED MAGNETIC STEEL HEAVY PLATE HAVING HIGH MAGNETIC FLUX DENSITY

BACKGROUND OF THE INVENTION

1. Field of the Invention

The present invention relates to a method of producing non-oriented magnetic steel heavy plate having high magnetic flux density, for magnetic cores used under DC magnetizing conditions and for magnetic shielding.

2. Description of the Prior Art

With the progress in recent years of elementary particle research and medical instruments, devices using magnets are being used in large structures and there is a demand for improved performance in such structures. Numerous electrical steel sheets having good magnetic flux density have been provided, especially silicon steel sheet and electrical mild steel sheet.

However, with respect to their use as structural members, there have been problems with the assembly fabrication and strength of such materials, and this has necessitated the use of steel heavy plate. So far, such electrical steel heavy plate has been produced using pure iron components, as in JP-A No. 60(1985)-96749, for example.

However, with the increase in the size and performance of the devices concerned, there is a strong demand for steel materials with better magnetic properties, especially a high magnetic flux density in a low magnetic field, for instance 80 A/m. With the known steel materials, high magnetic flux density in a low magnetic field of 80 A/m cannot be obtained stably.

SUMMARY OF THE INVENTION

An object of the present invention is to provide a method of producing non-oriented magnetic steel heavy plate having high magnetic flux density in a low magnetic field.

Another object of the present invention is to provide a method of producing non-oriented magnetic steel heavy plate having a tensile strength of 40 kg/mm$^2$ or more and a high magnetic flux density in a low magnetic field.

Another object of the present invention is to provide a method of producing non-oriented magnetic steel heavy plate having a tensile strength of 40 kg/mm$^2$ or more, a high specific resistance and a high magnetic flux density in a low magnetic field.

Another object of the present invention is to provide a method of producing non-oriented magnetic steel heavy plate having a low coercive force and a high magnetic flux density in a low magnetic field.

BRIEF DESCRIPTION OF THE DRAWINGS

The objects and features of the present invention will become more apparent from a consideration of the following detailed description taken in conjunction with the accompanying drawings in which.

DETAILED DESCRIPTION OF THE INVENTION

The process of magnetization to raise the magnetic flux density in a low magnetic field consists of placing degaussed steel in a magnetic field and changing the orientation of the magnetic domains by increasing the intensity of the magnetic field so that domains oriented substantially in the direction of the magnetic field become preponderant, encroaching on, and amalgamating with, other domains. That is to say, the domain walls are moved. When the magnetic field is further intensified and the moving of the domain walls is completed, the magnetic orientation of all the domains is changed. In this magnetization process, the ease with which the domain walls can be moved decides the magnetic flux density in a low magnetic field. That is, to obtain a high magnetic flux density in a low magnetic field, obstacles to the movement of the domain wall must be reduced as far as possible.

As means of obtaining a high magnetic flux density in a low magnetic field, the inventors carried out detailed investigations relating to crystal grain size, the effects of elements that cause internal stresses and cavity defects.

AlN has the effect of refining the size of crystal grains, so grain size can be coarsened by reducing the AlN. With reference to the production method, the heating temperature is raised as high as possible to coarsen the size of the austenite grains, and the finish rolling temperature is also raised as high as possible to prevent the crystal grain size being refined by the rolling process, together with which annealing conditions following rolling are used selectively.

Figure 1:
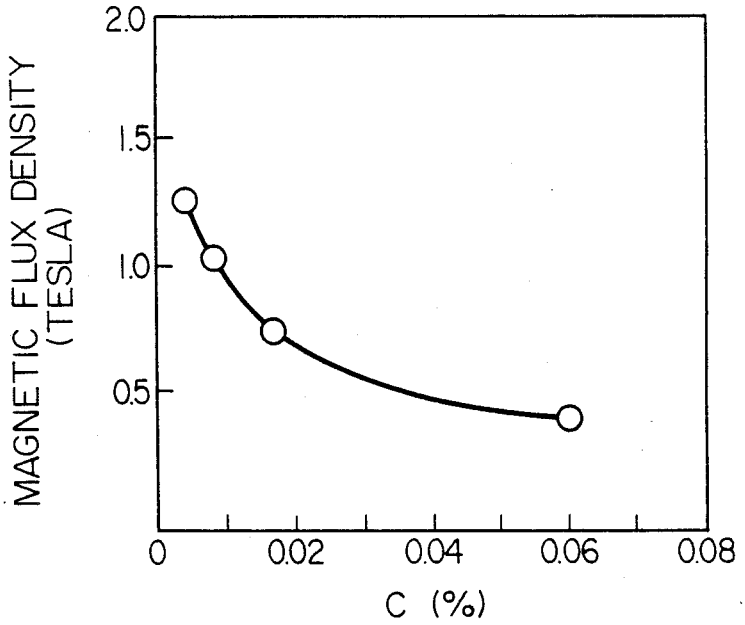
FIG. 1 is a graph showing the effect of the carbon content on magnetic flux density at 80 A/m.

Carbon has to be reduced to reduce internal stresses. FIG. 1 shows that as the carbon content is increased, magnetic flux density in a low magnetic field of 80 A/m goes down. For the samples, (0.01 Si—0.1 Mn—0.01 Al) steel was used.

With respect to the effect of cavity defects, it was found that there was a large degradation in the magnetic properties when cavity defects measured 100 micrometers or more. It was found that in order to eliminate such harmful cavity defects measuring 100 micrometers or more, a shape ratio A of 0.7 or more is required.

Figure 2:
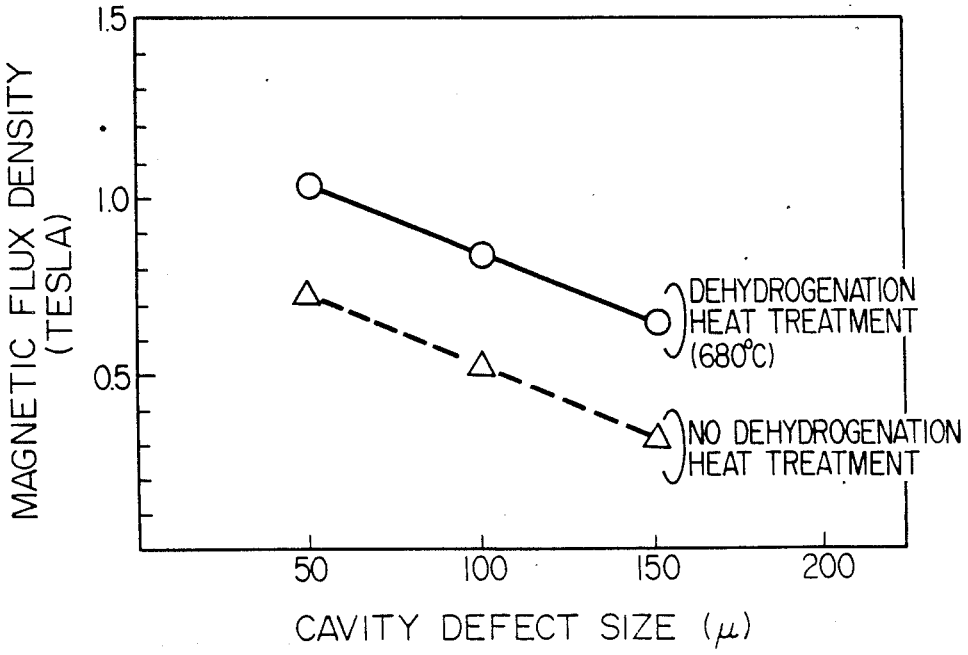
FIG. 2 is a graph showing the effect of cavity defect size and dehydrogenation heat treatment temperature on magnetic flux density at 80 A/m.

As shown by FIG. 2, the presence of hydrogen in the steel is deleterious, and it was discovered that the magnetic properties could be greatly improved by the use of dehydrogenation heat treatment.

FIG. 2 shows that by using high shape ratio rolling to reduce the size of cavity defects to less than 100 micrometers and reducing hydrogen in the steel by dehydrogenation heat treatment, magnetic flux density in a low magnetic field could be markedly raised. For the samples, (0.007 C—0.01 Si—0.1 Mn) steel was used.

Thus, the present invention comprises the steps of:

preparing a steel slab comprising, by weight, up to 0.01 percent carbon, up to 0.20 percent manganese, up to 0.015 percent phosphorus, up to 0.010 percent sulfur, up to 0.05 percent chromium, up to 2.0 percent nickel, up to 0.01 percent molybdenum, up to 0.01 percent copper, up to 0.004 percent nitrogen, up to 0.005 percent oxygen and up to 0.0002 percent hydrogen, and one or more deoxidizing agents selected from a group consisting of up to 4.0 percent silicon, up to 0.20 percent titanium, 0.005 to 0.40 percent aluminum, and up to 0.01 percent calcium, with the remainder being substantially iron;

heating the slab to a temperature of 1150° to 1350° C.;

carrying out at least one hot-rolling at a shape ratio A of at least 0.7 at a finish rolling temperature of at least 900° C.;

applying dehydrogenation heat treatment at between 600° and 750° C. for heavy plate with a gage thickness of 50 mm or more;

annealing at a temperature of 700° to 950° C. or normalizing at a temperature of 910° to 1000° C., as required;

applying annealing at a temperature of 750° to 50° C. or normalizing at a temperature of 910° to 1000° C. for hot-rolled heavy plate having a gage thickness that is at least 20 mm but less than 50 mm;

whereby a magnetic flux density of 0.8 tesla or more at a magnetic field of 80 A/m is imparted to the steel.

This is provided that:

$$A = (2\sqrt{R(h_1 - h_0)})/h_1 + h_0$$

where

A: rolled shape ratio $h_1$: entry-side plate thickness (mm)

$h_0$: exit-side plate thickness (mm)

R: radius (mm) of rolling roll

In this invention, preferably the steel is high purity steel comprised of up to 0.01 percent carbon, up to 0.02 percent silicon, up to 0.20 percent manganese, up to 0.015 percent phosphorus, up to 0.010 percent sulfur, up to 0.05 percent chromium, up to 0.01 percent molybdenum, up to 0.01 percent copper, 0.005 to 0.40 percent aluminum, up to 0.004 percent nitrogen, up to 0.005 percent oxygen and up to 0.0002 percent hydrogen, with the remainder being substantially iron.

The reasons for the component limitations in the high-purity steel referred to with respect to the present invention will now be explained.

Carbon increases internal stresses in steel and is the element most responsible for degradation of magnetic properties, especially magnetic flux density in a low magnetic field, and as such, minimizing the carbon content helps to prevent a drop in the magnetic flux density in a low magnetic field. Also, lowering the carbon content decreases the magnetic aging of the steel, and thereby extends the length of time the steel retains its good magnetic properties. Hence, carbon is limited to a maximum of 0.010 percent. As shown in FIG. 1, an even higher magnetic flux density can be obtained by reducing the carbon content to 0.005 percent or less.

Low silicon and manganese are desirable for achieving high magnetic flux density in a low magnetic field; low manganese is also desirable for reducing MnS inclusions. Therefore up to 0.02 percent is specified as the limit for silicon and up to 0.20 percent for manganese. To reduce MnS inclusions, a manganese content of no more than 0.10 percent is preferable.

Phosphorus, sulfur and oxygen produce non-metallic inclusions in the steel, and the segregation of these elements also obstructs the movement of the magnetic domain walls. As such, the higher the content amounts of these elements, the more pronounced the deterioration in the magnetic flux density and other magnetic properties. Therefore, an upper limit of 0.015 percent has been specified for phosphorus, 0.010 percent for sulfur, and 0.005 percent for oxygen.

Because of the adverse affect chromium, molybdenum and copper have on magnetic flux density in a low magnetic field, preferably the content amounts of these elements are kept as low as possible. Another reason for minimizing these elements is to reduce the degree of segregation. Accordingly, an upper limit of 0.05 percent has been specified for chromium, 0.01 percent for molybdenum and 0.01 percent for copper.

In its role as a deoxidizing agent, aluminum is an indispensable element for achieving internal uniformity in materials such as the plate according to the present invention, for which purpose a minimum of 0.005 percent is added. As excessive aluminum will give rise to inclusions, degrading the quality of the steel, an upper limit of 0.040 percent is specified. More preferably, the amount of aluminum should not exceed 0.020 percent in order to reduce the AlN which has the effect of refining the size of the crystal grains.

Because nitrogen increases internal stresses in the steel and in the form of AlN has the effect of refining the size of the crystal grains, thereby causing a deterioration in magnetic flux density in a low magnetic field, an upper limit of 0.004 percent has been specified.

To prevent hydrogen having an adverse effect on magnetic properties and preventing reductions in cavity defects, an upper limit of 0.0002 percent hydrogen has been specified.

The method for producing the steel will now be described. The steel is heated to a temperature of 1150° C. prior to rolling in order to coarsen the size of the austenite grains and improve the magnetic properties. An upper limit of 1300° C. is specified to prevent scaling loss and to conserve on energy.

If the finish rolling temperature is below 900° C., the rolling will refine the size of the crystal grains, adversely affecting the magnetic properties. As such, a temperature of 900° C. or more is specified with the aim of achieving an increase in the magnetic flux density as a result of a coarsening of the size of the crystal grains.

Regarding the hot rolling, the solidification process will always give rise to cavity defects, although the size of the defects may vary. Rolling has to be used to eliminate such cavity defects, and as such, hot rolling plays an important role. An effective means is to increase the amount of deformation per hot rolling, so that the deformation extends to the core of the plate.

Specifically, employing a high shape ratio which includes at least one pass at a shape ratio A of at least 0.7 so that the size of the cavity defects is no larger than 100 micrometers is conducive to obtaining desirable magnetic properties. Eliminating cavity defects in the rolling process by using this high shape ratio rolling markedly enhances dehydration efficiency in the subsequent dehydrogenation heat treatment.

The following shape ratio A is defined by the following equation.

$$A = (2\sqrt{R(h_1 - h_0)})/h_1 + h_0$$

where
A: rolled shape ratio
$h_1$: entry-side plate thickness (mm)
$h_0$: exit-side plate thickness (mm)
R: radius (mm) of rolling roll Continuing on from the hot rolling, dehydrogenation heat treatment is employed on heavy plate with a gage thickness of 50 mm or more to coarsen the size of the crystal grains and remove internal stresses. Hydrogen does not readily disperse in heavy plate having a thickness of 50 mm or more, which causes cavity defects and, together with the effect of the hydrogen itself, degrades magnetic flux density in a low magnetic field.

Because of this, dehydrogenation heat treatment is employed. However, if the temperature of the dehydrogenation heat treatment is below 600° C. the dehydrogenation efficiency is poor, while if the temperature exceeds 750° C. there is a partial onset of transformation. Therefore, a temperature range of 600° to 750° C. is specified. After various studies relating to dehydrogenation time, a time of $[0.6(t-50)+6]$was found to be suitable (here, t stands for the thickness of the plate).

The steel is annealed to coarsen the size of the crystal grains and remove internal stresses. A temperature below 750° C. will not produce coarsening of the crystal grains, while if the temperature exceeds 950° C., uniformity of the crystal grains in the thickness dimension of the plate cannot be maintained. Therefore an annealing temperature range of 750° to 950° C. has been specified.

Normalizing is carried out to adjust the crystal grains in the thickness dimension of the plate and to remove internal stresses. However, with an $Ac_3$ point temperature of below 910° C. or over 1000° C., uniformity of the crystal grains in the thickness dimension of the plate cannot be maintained, so a range of 910° to 1000° C. has been specified for the normalizing temperature.

The dehydrogenation heat treatment employed for heavy plates having a gage thickness of 50 mm or more can also be used for the annealing or normalizing. As hydrogen readily disperses in heavy plate that is from 20 mm to less than 50 mm thick, such heavy plate only requires annealing or normalizing, not dehydrogenation heat treatment.

As another example of the present invention, rolling conditions can be used to coarsen the size of the crystal grains.

Figure 3:
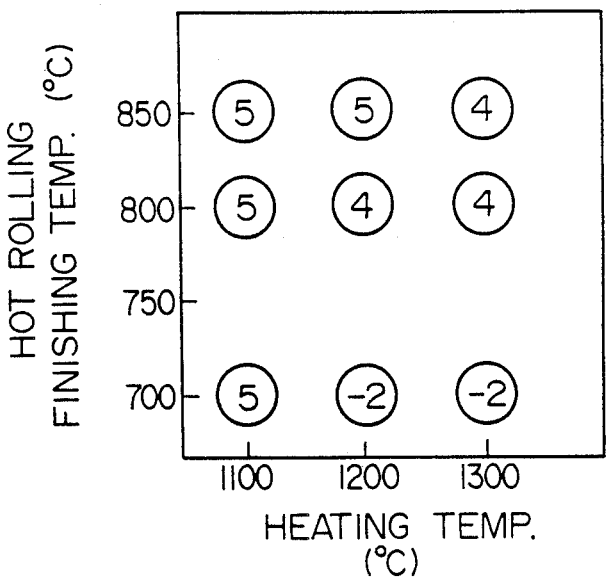
FIG. 3 is a graph showing the relationship between steel slab heating temperature/hot-rolling finishing temperature and ferrite grain number.

FIG. 3 shows the effect of the heating temperature and finishing temperature on ferrite grain number. The size of the heated austenite grains is coarsened by using the highest possible heating temperature and making the finishing temperature in the ferrite zone at or below the $Ar_3$ point. That is, a high degree of processing stresses are introduced into the ferrite portion, after which annealing or normalizing is used to produce abnormal grain growth, coarsening the size of the ferrite grains. More specifically, the size of the austenite grains is coarsened and the magnetic properties are enhanced by making the pre-rolling temperature 1200° C. or higher. An upper limit of 1350° C. is specified to prevent scaling loss and to conserve on energy.

By finishing the rolling at a temperature at or below the $Ar_3$ point of the ferrite zone, process stresses can be introduced into the ferrite portion and combined with the subsequent annealing or normalizing to obtain abnormal grain growth.

For the present invention, appropriate conditions have been elucidated whereby abnormal grain growth is achieved to coarsen the size of the ferrite grains by the introduction of cold-rolling processing stresses and the use of the following annealing conditions, which was hitherto not possible.

Figure 4:
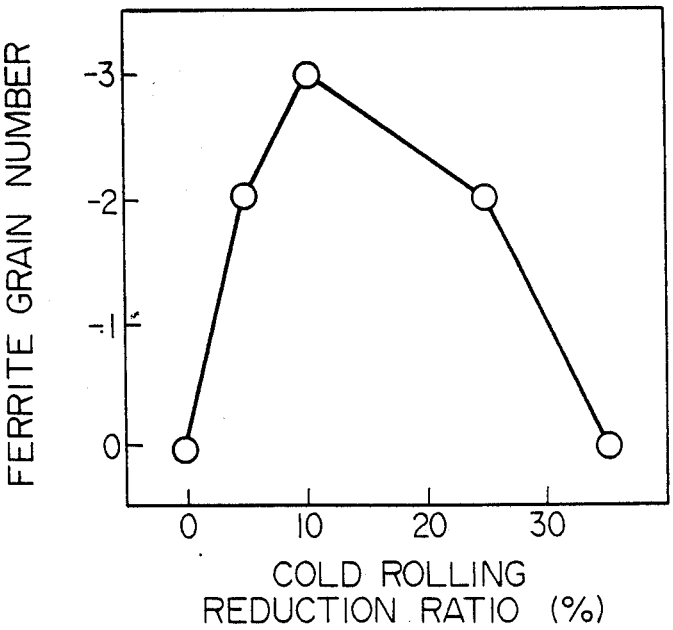
FIG. 4 is a graph showing the relationship between cold-rolling reduction ratio and ferrite grain number.

FIG. 4 shows the relationship between cold-rolling reduction ratio and ferrite grain size. A major coarsening of the size of the crystal grains occurs with a cold-rolling reduction ratio of between 5 percent and 25 percent, with the peak being around 10 percent. Therefore, cold rolling is combined with annealing with the aim of achieving a coarsening of the size of the ferrite grains through abnormal grain growth. A suitable cold-rolling reduction ratio for this is 5 to 25 percent.

The steel is annealed to coarsen the size of the crystal grains and remove internal stresses. A temperature below 750° C. will not produce a coarsening of the crystal grains, while if the temperature exceeds 950° C., uniformity of the crystal grains in the thickness dimension of the plate cannot be maintained. Therefore an annealing temperature range of 750° to 950° C. has been specified.

Figure 5:
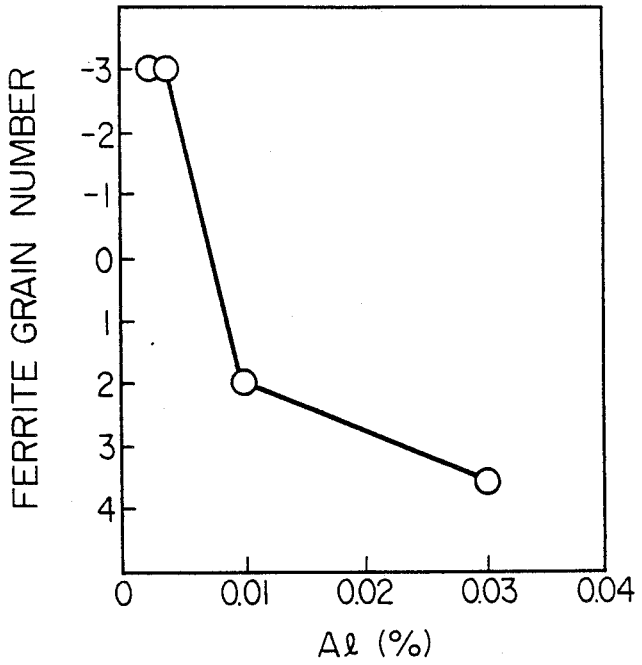
FIG. 5 is a graph showing the relationship between aluminum content and ferrite grain number.

Other examples whereby the size of the crystal grains is coarsened will now be described. AlN has the effect of refining the size of crystal grains, so grain size can be coarsened by reducing the AlN. As shown in FIG. 5, lower aluminum produces an increase in the growth of ferrite grains. Where no aluminum has been added, so there is no more the 0.005 percent aluminum, abnormal growth of crystal grains takes place. However, if aluminum is not added, it becomes necessary to add a different deoxidizing agent.

Instead of aluminum, the inventors found that silicon, titanium, or calcium are elements that can be used as deoxidizing agents and do not bring about a reduction of the magnetic flux density in a low magnetic field. The added amounts are: 0.1 to 1.0 percent silicon; 0.005 to 0.03 percent titanium; and 0.005 to 0.01 percent calcium. Titanium and calcium may be added in combination.

Figure 6:
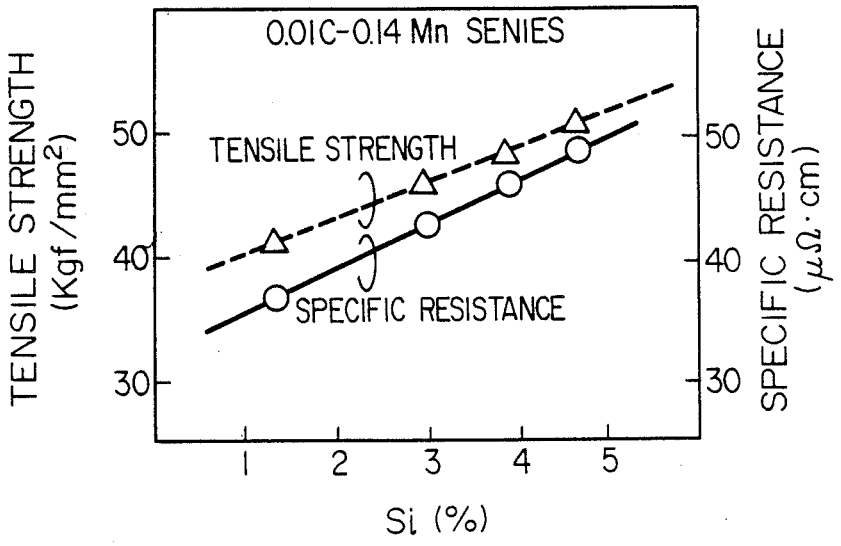
FIG. 6 is a graph showing the effect of silicon on tensile strength and specific resistance.

In addition, as shown in FIG. 6, using silicon as a deoxidizing agent where there is no added aluminum can impart to the steel a high tensile strength of 40 $kg/mm^2$ or more, and a high specific resistance of 35 $\mu\Omega\cdot cm$ or more. A range of 1.0 to 4.0 percent is specified as the amount to be added, because over 4.0 percent will cause a reduction in magnetic flux density in a low magnetic field.

Figure 7:
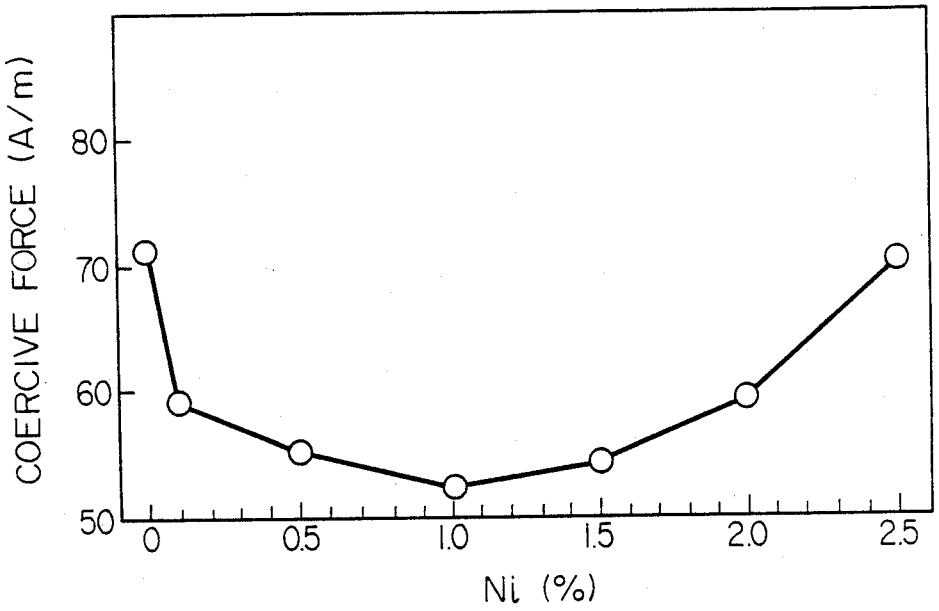
FIG. 7 is a graph showing the relationship between coercive force and nickel content.

Nickel is an effective element for reducing coercive force without reducing magnetic flux density in a low magnetic field. As shown in FIG. 7, at least 0.1 percent nickel is required to reduce the coercive force. A content of more than 2.0 percent nickel produces an increase in the coercive force and reduces the magnetic flux density in a low magnetic field, therefore a range of 0.1 to 2.0 percent has been specified. This range is also desirable as it enables the strength of the steel to be increased without reducing its magnetic properties.

Figure 8:
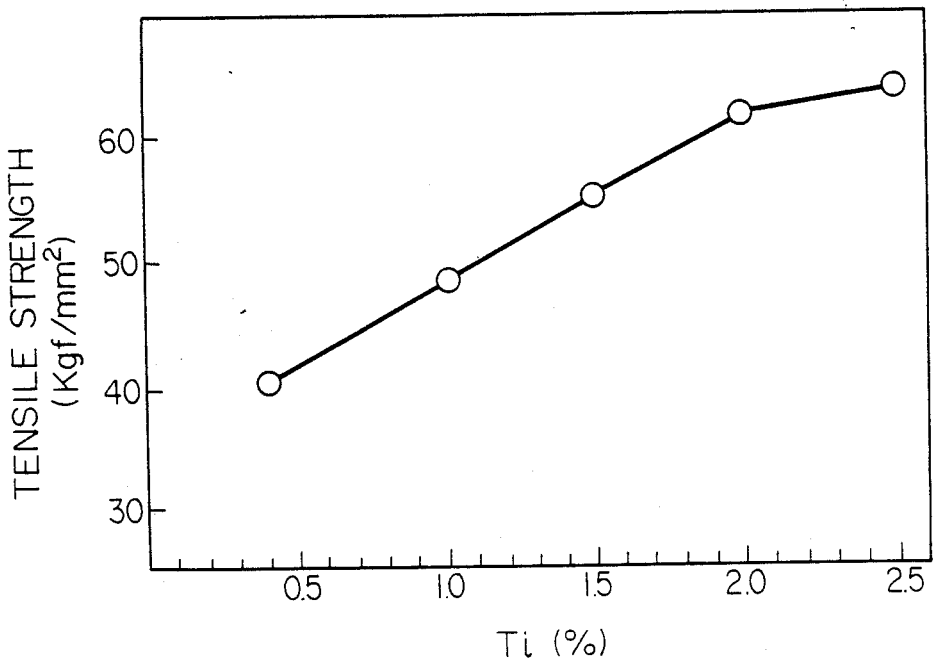
FIG. 8 is a graph showing the relationship between coercive force and titanium content.

When titanium is to be used as a deoxidizing agent where there is no added aluminum, i.e., the aluminum content is no more than 0.005 percent, and for achieving a high tensile strength of 40 $kg/mm^2$ or more, as shown in FIG. 8, at least 0.04 percent is required. However, as the magnetic flux density in a low magnetic field will be reduced if there is more than 0.20 percent titanium, a range of 0.04 to 0.20 percent is specified.

EXAMPLE 1

Electrical steel heavy plate having the compositions listed in Table 1 were produced using the inventive and comparative conditions listed in Table 2. As shown, steels 1 to 10 are inventive steels and steels 11 to 29 are comparative steels.

Steels 1 to 5, which were finished to a thickness of 100 mm and had coarse, uniform grains, exhibited good magnetic properties. Compared with steel 1, steel 2, with lower carbon, steels 3 and 4, with lower manganese, and steel 5, with lower aluminum, showed better magnetic properties. Steels 6 to 8, which were finished to a thickness of 500 mm, steel 9, which was finished to a thickness of 40 mm, and steel 10, which was finished to a thickness of 20 mm, each had coarse, uniform grains and exhibited good magnetic properties.

As a result of the upper limit being exceeded for carbon in steel 11, manganese in steel 12, phosphorus in steel 13, sulfur in steel 14, chromium in steel 15, molybdenum in steel 16, copper in steel 17, aluminum in steel 18, nitrogen in steel 19, oxygen in steel 20 and hydrogen in steel 21, each of these steels had poorer magnetic properties.

Poorer magnetic properties were also shown by steel 22 because the heating temperature used was too low, by steel 23 because the rolling finishing temperature was too low, by steel 24 because the maximum shape ratio was too low, by steel 25 because the dehydrogenation temperature was too low, by steel 26 because the annealing temperature was too low, by steel 27 because the normalizing temperature was too low and by steel 28 because no dehydrogenation was applied.

TABLE 1

| | Steel No. | (wt %) C | Si | Mn | P | S | Cr | Mo | Cu | Al | N | O | H |
|---|---|---|---|---|---|---|---|---|---|---|---|---|---|
| Invention | 1 | 0.007 | 0.01 | 0.15 | 0.010 | 0.003 | 0.04 | 0.007 | 0.01 | 0.030 | 0.003 | 0.004 | 0.00007 |
| | 2 | 0.003 | 0.01 | 0.14 | 0.011 | 0.003 | 0.03 | 0.008 | 0.01 | 0.035 | 0.003 | 0.003 | 0.00007 |
| | 3 | 0.007 | 0.01 | 0.08 | 0.009 | 0.003 | 0.03 | 0.010 | 0.01 | 0.035 | 0.003 | 0.003 | 0.00007 |
| | 4 | 0.006 | 0.01 | 0.01 | 0.012 | 0.002 | 0.04 | 0.008 | 0.01 | 0.025 | 0.003 | 0.003 | 0.00007 |
| | 5 | 0.007 | 0.01 | 0.15 | 0.008 | 0.008 | 0.03 | 0.009 | 0.01 | 0.010 | 0.002 | 0.004 | 0.00006 |
| | 6 | 0.008 | 0.02 | 0.14 | 0.005 | 0.008 | 0.04 | 0.007 | 0.01 | 0.030 | 0.002 | 0.004 | 0.00006 |
| | 7 | 0.008 | 0.02 | 0.14 | 0.005 | 0.008 | 0.04 | 0.007 | 0.01 | 0.030 | 0.002 | 0.004 | 0.00006 |
| | 8 | 0.008 | 0.02 | 0.14 | 0.005 | 0.004 | 0.04 | 0.007 | 0.01 | 0.030 | 0.002 | 0.004 | 0.00006 |
| | 9 | 0.006 | 0.01 | 0.17 | 0.007 | 0.003 | 0.02 | 0.009 | 0.01 | 0.032 | 0.003 | 0.003 | 0.00008 |
| | 10 | 0.007 | 0.01 | 0.15 | 0.009 | 0.005 | 0.04 | 0.008 | 0.01 | 0.025 | 0.003 | 0.002 | 0.00011 |
| Comparative | 11 | 0.020 | 0.01 | 0.16 | 0.012 | 0.004 | 0.05 | 0.009 | 0.01 | 0.030 | 0.003 | 0.003 | 0.00008 |
| | 12 | 0.007 | 0.01 | 0.30 | 0.012 | 0.002 | 0.04 | 0.008 | 0.01 | 0.038 | 0.002 | 0.002 | 0.00006 |
| | 13 | 0.008 | 0.01 | 0.15 | 0.020 | 0.001 | 0.04 | 0.007 | 0.01 | 0.035 | 0.002 | 0.003 | 0.00005 |
| | 14 | 0.006 | 0.01 | 0.14 | 0.010 | 0.015 | 0.03 | 0.006 | 0.01 | 0.035 | 0.002 | 0.003 | 0.00015 |
| | 15 | 0.007 | 0.01 | 0.15 | 0.010 | 0.003 | 0.10 | 0.005 | 0.01 | 0.036 | 0.002 | 0.002 | 0.00008 |
| | 16 | 0.006 | 0.01 | 0.13 | 0.012 | 0.003 | 0.04 | 0.050 | 0.01 | 0.035 | 0.003 | 0.002 | 0.00007 |
| | 17 | 0.007 | 0.02 | 0.13 | 0.013 | 0.002 | 0.04 | 0.007 | 0.03 | 0.020 | 0.003 | 0.002 | 0.00006 |
| | 18 | 0.009 | 0.01 | 0.15 | 0.013 | 0.003 | 0.04 | 0.006 | 0.01 | 0.060 | 0.003 | 0.003 | 0.00005 |
| | 19 | 0.008 | 0.01 | 0.16 | 0.014 | 0.002 | 0.03 | 0.005 | 0.01 | 0.030 | 0.006 | 0.003 | 0.00004 |
| | 20 | 0.008 | 0.01 | 0.13 | 0.015 | 0.006 | 0.02 | 0.009 | 0.01 | 0.029 | 0.002 | 0.010 | 0.00005 |
| | 21 | 0.007 | 0.01 | 0.12 | 0.014 | 0.006 | 0.02 | 0.009 | 0.01 | 0.025 | 0.002 | 0.003 | 0.00030 |
| | 22 | 0.008 | 0.01 | 0.16 | 0.010 | 0.002 | 0.02 | 0.008 | 0.01 | 0.025 | 0.002 | 0.002 | 0.00008 |
| | 23 | 0.007 | 0.01 | 0.16 | 0.008 | 0.002 | 0.04 | 0.008 | 0.01 | 0.030 | 0.003 | 0.002 | 0.00007 |
| | 24 | 0.006 | 0.02 | 0.17 | 0.002 | 0.008 | 0.04 | 0.007 | 0.01 | 0.038 | 0.003 | 0.003 | 0.00006 |
| | 25 | 0.009 | 0.01 | 0.16 | 0.001 | 0.008 | 0.04 | 0.006 | 0.01 | 0.036 | 0.003 | 0.003 | 0.00005 |
| | 26 | 0.007 | 0.01 | 0.16 | 0.012 | 0.002 | 0.03 | 0.005 | 0.01 | 0.025 | 0.002 | 0.002 | 0.00004 |
| | 27 | 0.008 | 0.01 | 0.17 | 0.012 | 0.002 | 0.03 | 0.004 | 0.01 | 0.036 | 0.003 | 0.002 | 0.00018 |
| | 28 | 0.008 | 0.01 | 0.15 | 0.013 | 0.002 | 0.03 | 0.005 | 0.01 | 0.029 | 0.002 | 0.003 | 0.00008 |

TABLE 2

| | Steel No. | Heating Temp. (°C.) | Finish Rolling Temp. (°C.) | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Invention | 1 | 1250 | 940 | 0.9 | 700 | — | — | 100 | 20 | 0 | 0.95 |
| | 2 | 1250 | 940 | 0.9 | 700 | — | — | 100 | 25 | 0 | 1.25 |
| | 3 | 1250 | 940 | 0.9 | 700 | — | — | 100 | 25 | 0 | 1.18 |
| | 4 | 1250 | 940 | 0.9 | 700 | — | — | 100 | 20 | 0 | 1.24 |
| | 5 | 1150 | 940 | 0.9 | 700 | — | — | 100 | 25 | 0 | 1.15 |
| | 6 | 1250 | 980 | 0.8 | 720 | — | — | 500 | 90 | −1 | 0.95 |
| | 7 | 1250 | 980 | 0.8 | 720 | 850 | — | 500 | 90 | −1 | 1.00 |
| | 8 | 1250 | 980 | 0.8 | 720 | — | 930 | 500 | 90 | −1 | 0.97 |
| | 9 | 1250 | 920 | 1.1 | — | 850 | — | 40 | 10 | 0 | 1.05 |
| | 10 | 1250 | 910 | 1.2 | — | — | 930 | 20 | 5 | 0 | 1.00 |
| Comparative | 11 | 1250 | 930 | 0.85 | 680 | — | — | 200 | 80 | 0 | 0.40 |
| | 12 | 1200 | 930 | 0.85 | 680 | — | — | 200 | 80 | 0 | 0.70 |
| | 13 | 1250 | 930 | 0.85 | 680 | — | — | 200 | 85 | 0 | 0.65 |
| | 14 | 1250 | 930 | 0.85 | 680 | — | — | 200 | 75 | 3 | 0.70 |
| | 15 | 1250 | 930 | 0.85 | 680 | — | — | 200 | 80 | 0 | 0.71 |
| | 16 | 1250 | 930 | 0.85 | 680 | — | — | 200 | 80 | 0 | 0.68 |
| | 17 | 1250 | 930 | 0.85 | 680 | — | — | 200 | 75 | 0 | 0.70 |
| | 18 | 1250 | 930 | 0.85 | 680 | — | — | 200 | 80 | 5 | 0.55 |
| | 19 | 1250 | 930 | 0.85 | 680 | — | — | 200 | 75 | 4 | 0.60 |
| | 20 | 1250 | 930 | 0.85 | 680 | — | — | 200 | 80 | 0 | 0.65 |
| | 21 | 1250 | 930 | 0.85 | 680 | — | — | 200 | 95 | 0 | 0.65 |

TABLE 2-continued

| Steel No. | Heating Temp. (°C.) | Finish Rolling Temp. (°C.) | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|
| 22 | 1050 | 930 | 0.85 | 680 | — | — | 200 | 80 | 6 | 0.50 |
| 23 | 1200 | 850 | 0.85 | 680 | — | — | 200 | 75 | 5 | 0.55 |
| 24 | 1200 | 930 | 0.6 | 680 | — | — | 200 | 150 | 2 | 0.65 |
| 25 | 1200 | 920 | 0.9 | 550 | — | — | 200 | 80 | 0 | 0.60 |
| 26 | 1200 | 920 | 1.1 | — | 700 | — | 40 | 10 | 0 | 0.60 |
| 27 | 1200 | 920 | 1.1 | — | — | 1050 | 40 | 10 | 0 | 0.65 |
| 28 | 1200 | 920 | 0.9 | — | 850 | — | 200 | 70 | 0 | 0.60 |

EXAMPLE 2

Steels 5 to 10 and steels 22 and 23 of Example 1 were used to produce electrical steel heavy plates using the heating conditions and hot-rolling finishing temperatures listed in Table 3.

Inventive steels 5 to 10, which each had coarse, uniform grains, exhibited a high magnetic flux density. Comparative steels 22 and 23 showed poor magnetic properties owing to the heating temperature being too low in the case of the former and the rolling finishing temperature too low in the case of the latter.

TABLE 4

| | Steel No. | Heating Temp. (°C.) | Finish Rolling Temp. (°C.) | Shape Ratio | Dehydrogenate Heat treating Temp. (°C.) | Cold Rolling Reduction (%) | Normalizing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Invention | 5 | 1150 | 940 | 0.9 | 700 | 10 | 850 | 120 | 25 | −3 | 1.30 |
| | 6 | 1250 | 990 | 0.8 | 720 | 10 | 850 | 550 | 90 | −3 | 1.10 |
| | 7 | 1250 | 980 | 0.8 | 720 | 5 | 850 | 550 | 90 | −2 | 1.00 |
| | 8 | 1250 | 980 | 0.8 | 720 | 25 | 850 | 550 | 90 | −2 | 0.98 |
| | 9 | 1250 | 920 | 1.1 | — | 15 | 750 | 50 | 10 | −2 | 1.20 |
| | 10 | 1250 | 910 | 1.2 | — | 15 | 950 | 20 | 5 | −2 | 1.15 |
| Comparative | 22 | 1050 | 930 | 0.85 | 680 | 10 | 850 | 250 | 80 | 4 | 0.55 |
| | 23 | 1200 | 850 | 0.85 | 680 | 10 | 850 | 250 | 75 | 3 | 0.60 |

Inventive steels 5 to 10, which each had coarse, uniform grains, exhibited good magnetic properties. Comparative steels 22 and 23 showed inferior magnetic flux densities owing to the heating temperature being too low in the case of the former and the rolling finishing temperature too high in the case of the latter.

TABLE 3

| | Steel No. | Heating Temp. (°C.) | Finish Rolling Temp. (°C.) | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Invention | 5 | 1200 | 700 | 0.9 | 700 | — | — | 100 | 25 | −1 | 1.25 |
| | 6 | 1250 | 710 | 0.8 | 720 | — | — | 500 | 90 | −2 | 1.05 |
| | 7 | 1250 | 710 | 0.8 | 720 | 850 | — | 500 | 90 | −2 | 1.10 |
| | 8 | 1250 | 710 | 0.8 | 720 | — | 930 | 500 | 90 | −2 | 1.07 |
| | 9 | 1300 | 690 | 1.1 | — | 850 | — | 40 | 10 | −1 | 1.15 |
| | 10 | 1300 | 690 | 1.2 | — | — | 930 | 20 | 5 | −1 | 1.10 |
| Comparative | 22 | 1150 | 710 | 0.85 | 680 | — | — | 200 | 80 | 5 | 0.55 |
| | 23 | 1250 | 850 | 0.85 | 680 | — | — | 200 | 75 | 5 | 0.55 |

EXAMPLE 3

Steels 5 to 10 and steels 22 and 23 of Example 1 were used to produce electrical steel heavy plates using the conditions listed in Table 4.

EXAMPLE 4

Electrical steel heavy plate having the compositions listed in Table 5 were produced using the conditions listed in Table 6.

Inventive steels 29 to 35, which each had coarse, uniform grains, exhibited good magnetic properties.

TABLE 5

| | Steel No. | (wt %) C | Si | Mn | P | S | Cr | Mo | Cu | Al | N | O | H |
|---|---|---|---|---|---|---|---|---|---|---|---|---|---|
| Invention | 29 | 0.007 | 0.5 | 0.16 | 0.011 | 0.003 | 0.03 | 0.008 | 0.01 | 0.003 | 0.003 | 0.003 | 0.00006 |
| | 30 | 0.007 | 0.3 | 0.15 | 0.008 | 0.008 | 0.03 | 0.009 | 0.01 | 0.001 | 0.002 | 0.004 | 0.00006 |
| | 31 | 0.008 | 0.3 | 0.14 | 0.005 | 0.008 | 0.04 | 0.007 | 0.01 | 0.003 | 0.002 | 0.004 | 0.00006 |
| | 32 | 0.008 | 0.4 | 0.14 | 0.005 | 0.008 | 0.04 | 0.007 | 0.01 | 0.004 | 0.002 | 0.004 | 0.00006 |
| | 33 | 0.008 | 0.3 | 0.14 | 0.005 | 0.008 | 0.04 | 0.007 | 0.01 | 0.003 | 0.002 | 0.004 | 0.00006 |
| | 34 | 0.006 | 0.3 | 0.17 | 0.007 | 0.003 | 0.02 | 0.009 | 0.01 | 0.003 | 0.003 | 0.003 | 0.00008 |
| | 35 | 0.007 | 0.3 | 0.15 | 0.009 | 0.005 | 0.04 | 0.008 | 0.01 | 0.002 | 0.003 | 0.002 | 0.00011 |

TABLE 6

| | Steel No. | Heating Temp. (°C.) | Finish Rolling Temp. (°C.) | Shape Ratio | Dehydrogenate Heat treating Temp. (°C.) | Annealing Temp. (°C.) | Normal-izing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Inven-tion | 29 | 1250 | 940 | 0.9 | 700 | — | — | 100 | 25 | −3 | 0.95 |
| | 30 | 1150 | 940 | 0.9 | 700 | — | — | 100 | 50 | −3 | 1.25 |
| | 31 | 1250 | 980 | 0.8 | 720 | — | — | 500 | 90 | −2 | 1.05 |
| | 32 | 1250 | 980 | 0.8 | 720 | 850 | — | 500 | 90 | −2 | 1.10 |
| | 33 | 1250 | 980 | 0.8 | 720 | — | 930 | 500 | 90 | −2 | 1.07 |
| | 34 | 1250 | 920 | 1.1 | — | 850 | — | 40 | 10 | −3 | 1.15 |
| | 35 | 1250 | 910 | 1.2 | — | — | 930 | 20 | 5 | −3 | 1.10 |

EXAMPLE 5

Electrical steel heavy plate having the compositions listed in Table 7 were produced using the conditions listed in Table 8.

Inventive steels 36 to 41, which each had coarse, uniform grains, exhibited good magnetic properties.

Comparative steels 42 and 43, each having high aluminum, showed poor magnetic properties.

EXAMPLE 6

Electrical steel heavy plate having the compositions listed in Table 9 were produced using the conditions listed in Table 10.

Inventive steels 44 to 49, which each had coarse, uniform grains, exhibited good magnetic properties.

Comparative steels 42, with high calcium, and 43, with high aluminum, showed poor magnetic properties.

TABLE 7

| | Steel No. | (wt %) C | Si | Mn | P | S | Cr | Mo | Cu | Ti | Al | N | O | H |
|---|---|---|---|---|---|---|---|---|---|---|---|---|---|---|
| Inven-tion | 36 | 0.007 | 0.02 | 0.15 | 0.008 | 0.008 | 0.03 | 0.009 | 0.01 | 0.001 | 0.001 | 0.002 | 0.004 | 0.00006 |
| | 37 | 0.008 | 0.01 | 0.14 | 0.005 | 0.008 | 0.04 | 0.007 | 0.01 | 0.002 | 0.003 | 0.002 | 0.004 | 0.00006 |
| | 38 | 0.008 | 0.01 | 0.14 | 0.005 | 0.008 | 0.04 | 0.007 | 0.01 | 0.002 | 0.004 | 0.002 | 0.004 | 0.00006 |
| | 39 | 0.008 | 0.01 | 0.14 | 0.005 | 0.008 | 0.04 | 0.007 | 0.01 | 0.002 | 0.003 | 0.002 | 0.004 | 0.00006 |
| | 40 | 0.006 | 0.01 | 0.17 | 0.007 | 0.003 | 0.02 | 0.009 | 0.01 | 0.002 | 0.003 | 0.003 | 0.003 | 0.00008 |
| | 41 | 0.007 | 0.02 | 0.15 | 0.009 | 0.005 | 0.04 | 0.008 | 0.01 | 0.002 | 0.002 | 0.003 | 0.002 | 0.00011 |
| Compara-tive | 42 | 0.009 | 0.01 | 0.15 | 0.013 | 0.003 | 0.04 | 0.006 | 0.01 | 0.01 | 0.010 | 0.003 | 0.003 | 0.00005 |
| | 43 | 0.006 | 0.01 | 0.12 | 0.008 | 0.002 | 0.04 | 0.008 | 0.01 | 0.01 | 0.040 | 0.003 | 0.003 | 0.00005 |

TABLE 8

| | Steel No. | Heating Temp. (°C.) | Finish Rolling Temp. (°C.) | Shape Ratio | Dehydrogenate Heat treating Temp. (°C.) | Annealing Temp. (°C.) | Normal-izing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Inven-tion | 36 | 1150 | 940 | 0.9 | 700 | — | — | 100 | 50 | −3 | 1.23 |
| | 37 | 1250 | 980 | 0.8 | 720 | — | — | 500 | 90 | −2 | 1.03 |
| | 38 | 1250 | 980 | 0.8 | 720 | 850 | — | 500 | 90 | −2 | 1.08 |
| | 39 | 1250 | 980 | 0.8 | 720 | — | 930 | 500 | 90 | −2 | 1.05 |
| | 40 | 1250 | 920 | 1.1 | — | 850 | — | 40 | 10 | −3 | 1.13 |
| | 41 | 1250 | 910 | 1.2 | — | — | 930 | 20 | 5 | −3 | 1.08 |
| Compara-tive | 42 | 1250 | 930 | 0.95 | 680 | — | — | 200 | 80 | 4 | 0.53 |
| | 43 | 1250 | 930 | 0.85 | 680 | — | — | 200 | 85 | 5 | 0.38 |

TABLE 9

| | Steel No. | (wt %) C | Si | Mn | P | S | Cr | Mo | Cu | Ca | Al | N | O | H |
|---|---|---|---|---|---|---|---|---|---|---|---|---|---|---|
| Inven-tion | 44 | 0.007 | 0.02 | 0.15 | 0.008 | 0.008 | 0.03 | 0.009 | 0.01 | 0.002 | 0.001 | 0.002 | 0.004 | 0.00006 |
| | 45 | 0.008 | 0.01 | 0.14 | 0.005 | 0.008 | 0.04 | 0.007 | 0.01 | 0.001 | 0.003 | 0.002 | 0.004 | 0.00006 |
| | 46 | 0.008 | 0.01 | 0.14 | 0.005 | 0.008 | 0.04 | 0.007 | 0.01 | 0.003 | 0.004 | 0.002 | 0.004 | 0.00006 |
| | 47 | 0.008 | 0.01 | 0.14 | 0.005 | 0.008 | 0.04 | 0.007 | 0.01 | 0.003 | 0.003 | 0.002 | 0.004 | 0.00006 |
| | 48 | 0.006 | 0.01 | 0.17 | 0.007 | 0.003 | 0.02 | 0.009 | 0.01 | 0.003 | 0.003 | 0.003 | 0.003 | 0.00008 |
| | 49 | 0.007 | 0.02 | 0.15 | 0.009 | 0.005 | 0.04 | 0.008 | 0.01 | 0.001 | 0.002 | 0.003 | 0.002 | 0.00011 |
| Compara-tive | 50 | 0.007 | 0.01 | 0.14 | 0.009 | 0.06 | 0.03 | 0.008 | 0.01 | 0.020 | 0.003 | 0.003 | 0.003 | 0.00006 |
| | 51 | 0.006 | 0.01 | 0.12 | 0.008 | 0.002 | 0.04 | 0.008 | 0.01 | 0.001 | 0.040 | 0.003 | 0.003 | 0.00005 |

TABLE 10

| | Steel No. | Heating Temp. (°C.) | Finish Rolling Temp. (°C.) | Shape Ratio | Dehydrogenate Heat treating Temp. (°C.) | Annealing Temp. (°C.) | Normal-izing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Inven-tion | 44 | 1150 | 940 | 0.9 | 700 | — | — | 100 | 25 | −3 | 1.22 |
| | 45 | 1250 | 980 | 0.8 | 720 | — | — | 500 | 90 | −2 | 1.02 |
| | 46 | 1250 | 980 | 0.8 | 720 | 850 | — | 500 | 90 | −2 | 1.09 |
| | 47 | 1250 | 980 | 0.8 | 720 | — | 930 | 500 | 90 | −2 | 1.04 |

TABLE 10-continued

| | Steel No. | Heating Temp. (°C.) | Finish Rolling Temp. (°C.) | Shape Ratio | Dehydrogenate Heat treating Temp. (°C.) | Annealing Temp. (°C.) | Normal-izing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| | 48 | 1250 | 920 | 1.1 | — | 850 | — | 40 | 10 | −3 | 1.14 |
| | 49 | 1250 | 910 | 1.2 | — | — | 930 | 20 | 5 | −3 | 1.09 |
| Compara- | 50 | 1250 | 930 | 0.85 | 680 | — | — | 200 | 85 | 0 | 0.45 |
| tive | 51 | 1250 | 930 | 0.85 | 680 | — | — | 200 | 85 | 5 | 0.40 |

EXAMPLE 7

Electrical steel heavy plate having the compositions listed in Table 11 were produced using the conditions listed in Table 12.

Inventive steels 52 to 56, which each had coarse, uniform grains, exhibited good magnetic properties.

Comparative steels 57, which had high titanium, 58, which had high calcium, 59, which had high titanium and high calcium, and 60, which had high aluminum, each showed poor magnetic properties.

EXAMPLE 8

Electrical steel heavy plate having the compositions listed in Table 13 were produced using the conditions listed in Table 14.

Inventive steels 61 to 67, which each had coarse, uniform grains, exhibited a tensile strength of 40 kg/mm$^2$ or more, high specific resistance and high magnetic flux density in a low magnetic field.

Comparative steel 68, with low silicon, had low tensile strength and specific resistance. Comparative steels 69, with high silicon, and 70, with high aluminum, each had a low magnetic flux density.

TABLE 11

| | Steel | (wt %) | | | | | | | | | | | | | |
|---|---|---|---|---|---|---|---|---|---|---|---|---|---|---|---|
| | No. | C | Si | Mn | P | S | Cr | Mo | Cu | Ti | Ca | Al | N | O | H |
| Inven- | 52 | 0.008 | 0.01 | 0.14 | 0.005 | 0.008 | 0.04 | 0.007 | 0.01 | 0.02 | 0.002 | 0.003 | 0.002 | 0.004 | 0.00006 |
| tion | 53 | 0.008 | 0.01 | 0.14 | 0.005 | 0.008 | 0.04 | 0.007 | 0.01 | 0.02 | 0.003 | 0.004 | 0.002 | 0.004 | 0.00006 |
| | 54 | 0.008 | 0.01 | 0.14 | 0.005 | 0.008 | 0.04 | 0.007 | 0.01 | 0.02 | 0.002 | 0.003 | 0.002 | 0.004 | 0.00006 |
| | 55 | 0.006 | 0.01 | 0.17 | 0.007 | 0.003 | 0.02 | 0.009 | 0.01 | 0.02 | 0.001 | 0.003 | 0.003 | 0.003 | 0.00008 |
| | 56 | 0.007 | 0.02 | 0.15 | 0.009 | 0.005 | 0.04 | 0.008 | 0.01 | 0.02 | 0.001 | 0.002 | 0.003 | 0.002 | 0.00011 |
| Compara- | 57 | 0.007 | 0.01 | 0.14 | 0.009 | 0.003 | 0.03 | 0.008 | 0.01 | 0.04 | 0.001 | 0.003 | 0.003 | 0.003 | 0.00006 |
| tive | 58 | 0.007 | 0.01 | 0.13 | 0.008 | 0.003 | 0.03 | 0.007 | 0.01 | 0.02 | 0.02 | 0.003 | 0.003 | 0.003 | 0.00007 |
| | 59 | 0.008 | 0.01 | 0.14 | 0.008 | 0.003 | 0.03 | 0.007 | 0.01 | 0.04 | 0.02 | 0.003 | 0.003 | 0.003 | 0.00007 |
| | 60 | 0.009 | 0.01 | 0.15 | 0.013 | 0.003 | 0.04 | 0.006 | 0.01 | 0.01 | 0.002 | 0.010 | 0.003 | 0.003 | 0.00005 |

TABLE 12

| | Steel No. | Heating Temp. (°C.) | Finish Rolling Temp. (°C.) | Shape Ratio | Dehydrogenate Heat treating Temp. (°C.) | Annealing Temp. (°C.) | Normal-izing Temp. (°C.) | Thickness (mm) | Cavity Defect Size (μ) | Ferrite Grain No. | Magnetic Flux Density (at 80A/m) (tesla) |
|---|---|---|---|---|---|---|---|---|---|---|---|
| Inven- | 52 | 1250 | 980 | 0.8 | 720 | — | — | 500 | 90 | −2 | 1.05 |
| tion | 53 | 1250 | 980 | 0.8 | 720 | 850 | — | 500 | 90 | −2 | 1.11 |
| | 54 | 1250 | 980 | 0.8 | 720 | — | 930 | 500 | 90 | −2 | 1.08 |
| | 55 | 1250 | 920 | 1.1 | — | 850 | — | 40 | 10 | −3 | 1.16 |
| | 56 | 1250 | 910 | 1.2 | — | — | 930 | 20 | 5 | −3 | 1.11 |
| Compara- | 57 | 1250 | 930 | 0.85 | 680 | — | — | 200 | 85 | 0 | 0.42 |
| tive | 58 | 1250 | 930 | 0.85 | 680 | — | — | 200 | 80 | 0 | 0.40 |
| | 59 | 1250 | 930 | 0.85 | 680 | — | — | 200 | 85 | 0 | 0.38 |
| | 60 | 1250 | 930 | 0.85 | 680 | — | — | 200 | 80 | 4 | 0.55 |

TABLE 13

| | Steel | (wt %) | | | | | | | | | | | |
|---|---|---|---|---|---|---|---|---|---|---|---|---|---|
| | No. | C | Si | Mn | P | S | Cr | Mo | Cu | Al | N | O | H |
| Inven- | 61 | 0.007 | 3.2 | 0.15 | 0.008 | 0.004 | 0.03 | 0.009 | 0.01 | 0.010 | 0.002 | 0.004 | 0.00006 |
| tion | 62 | 0.007 | 3.2 | 0.13 | 0.009 | 0.003 | 0.03 | 0.008 | 0.01 | 0.003 | 0.002 | 0.004 | 0.00008 |
| | 63 | 0.008 | 3.0 | 0.14 | 0.005 | 0.008 | 0.04 | 0.007 | 0.01 | 0.030 | 0.002 | 0.004 | 0.00006 |
| | 64 | 0.008 | 2.0 | 0.14 | 0.005 | 0.008 | 0.04 | 0.007 | 0.01 | 0.030 | 0.002 | 0.004 | 0.00006 |
| | 65 | 0.008 | 3.2 | 0.14 | 0.005 | 0.008 | 0.04 | 0.007 | 0.01 | 0.030 | 0.002 | 0.004 | 0.00006 |
| | 66 | 0.006 | 3.8 | 0.17 | 0.007 | 0.003 | 0.02 | 0.009 | 0.01 | 0.032 | 0.003 | 0.003 | 0.00008 |
| | 67 | 0.007 | 3.6 | 0.15 | 0.009 | 0.005 | 0.04 | 0.008 | 0.01 | 0.025 | 0.003 | 0.002 | 0.00011 |
| Compara- | 68 | 0.006 | 0.5 | 0.14 | 0.010 | 0.003 | 0.03 | 0.006 | 0.01 | 0.039 | 0.003 | 0.002 | 0.00007 |
| tive | 69 | 0.007 | 4.5 | 0.13 | 0.009 | 0.002 | 0.02 | 0.007 | 0.01 | 0.021 | 0.002 | 0.003 | 0.00008 |
| | 70 | 0.009 | 2.0 | 0.15 | 0.013 | 0.003 | 0.04 | 0.006 | 0.01 | 0.060 | 0.003 | 0.003 | 0.00005 |

TABLE 14

| | Steel No. | Heating Temp. (°C.) | Finish Rolling Temp. (°C.) | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Tensil Strength (kgf/mm²) | Magnetic Flux Density (at 80A/m) (tesla | Resistivity (μΩ · cm) |
|---|---|---|---|---|---|---|---|---|---|---|---|---|---|
| Invention | 61 | 1150 | 940 | 0.9 | 700 | — | — | 100 | 25 | −1 | 46.3 | 1.15 | 44.6 |
| | 62 | 1150 | 940 | 0.9 | 700 | — | — | 100 | 20 | −3 | 46.5 | 1.30 | 44.3 |
| | 63 | 1250 | 980 | 0.8 | 720 | — | — | 500 | 90 | −1 | 46.3 | 0.95 | 43.2 |
| | 64 | 1250 | 980 | 0.8 | 720 | 850 | — | 500 | 90 | −1 | 43.2 | 1.00 | 39.8 |
| | 65 | 1250 | 980 | 0.8 | 720 | — | 930 | 500 | 90 | −1 | 46.2 | 0.97 | 44.5 |
| | 66 | 1250 | 920 | 1.1 | — | 850 | — | 40 | 10 | 0 | 48.5 | 1.05 | 46.1 |
| | 67 | 1250 | 910 | 1.2 | — | — | 930 | 20 | 5 | 0 | 48.0 | 1.00 | 45.1 |
| Comparative | 68 | 1250 | 930 | 0.85 | 680 | — | — | 200 | 85 | 0 | 38.0 | 0.82 | 33.1 |
| | 69 | 1250 | 930 | 0.85 | 680 | — | — | 200 | 80 | 0 | 51.1 | 0.43 | 48.4 |
| | 70 | 1250 | 930 | 0.85 | 680 | — | — | 200 | 80 | 5 | 43.2 | 0.55 | 39.7 |

EXAMPLE 9

Electrical steel heavy plate having the compositions listed in Table 15 were produced using the conditions listed in Table 16.

Inventive steels 71 to 77, which each had coarse, uniform grains, exhibited a high magnetic flux density in a low magnetic field, and a low coercive force.

Comparative steel 78, with low nickel, which did show a high magnetic flux density in a low magnetic field, had a high coercive force. Because of excessive nickel, comparative steel 79 exhibited a low magnetic flux density in a low magnetic field together with a high coercive force. Comparative steel 80, with high aluminum, showed a low magnetic flux density in a low magnetic field.

TABLE 15

| | Steel No. | (wt %) C | Si | Mn | P | S | Cr | Mo | Cu | Ni | Al | N | O | H |
|---|---|---|---|---|---|---|---|---|---|---|---|---|---|---|
| Invention | 71 | 0.006 | 0.01 | 0.01 | 0.012 | 0.002 | 0.04 | 0.008 | 0.01 | 2.0 | 0.025 | 0.003 | 0.003 | 0.00007 |
| | 72 | 0.007 | 0.01 | 0.15 | 0.008 | 0.008 | 0.03 | 0.009 | 0.01 | 1.0 | 0.010 | 0.002 | 0.004 | 0.00006 |
| | 73 | 0.008 | 0.02 | 0.14 | 0.005 | 0.008 | 0.04 | 0.007 | 0.01 | 0.9 | 0.030 | 0.002 | 0.004 | 0.00006 |
| | 74 | 0.008 | 0.02 | 0.14 | 0.005 | 0.008 | 0.04 | 0.007 | 0.01 | 1.0 | 0.030 | 0.002 | 0.004 | 0.00006 |
| | 75 | 0.008 | 0.02 | 0.14 | 0.005 | 0.008 | 0.04 | 0.007 | 0.01 | 1.0 | 0.030 | 0.002 | 0.004 | 0.00006 |
| | 76 | 0.006 | 0.01 | 0.17 | 0.007 | 0.003 | 0.02 | 0.009 | 0.01 | 1.0 | 0.032 | 0.003 | 0.003 | 0.00008 |
| | 77 | 0.007 | 0.01 | 0.15 | 0.009 | 0.005 | 0.04 | 0.008 | 0.01 | 1.0 | 0.025 | 0.003 | 0.002 | 0.00011 |
| Comparative | 78 | 0.007 | 0.01 | 0.14 | 0.012 | 0.002 | 0.03 | 0.007 | 0.01 | 0.05 | 0.025 | 0.002 | 0.003 | 0.00009 |
| | 79 | 0.007 | 0.01 | 0.13 | 0.010 | 0.002 | 0.03 | 0.006 | 0.01 | 2.5 | 0.023 | 0.002 | 0.003 | 0.00008 |
| | 80 | 0.009 | 0.01 | 0.15 | 0.013 | 0.003 | 0.04 | 0.006 | 0.01 | 1.0 | 0.060 | 0.003 | 0.003 | 0.00005 |

TABLE 16

| | Steel No. | Heating Temp. (°C.) | Finish Rolling Temp. (°C.) | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80A/m) (tesla) | Coercive Force (A/m) |
|---|---|---|---|---|---|---|---|---|---|---|---|---|
| Invention | 71 | 1250 | 940 | 0.9 | 700 | — | — | 100 | 20 | 0 | 1.22 | 59 |
| | 72 | 1150 | 940 | 0.9 | 700 | — | — | 100 | 25 | −1 | 1.13 | 55 |
| | 73 | 1250 | 980 | 0.8 | 720 | — | — | 500 | 90 | −1 | 0.93 | 56 |
| | 74 | 1250 | 980 | 0.8 | 720 | 850 | — | 500 | 90 | −1 | 0.98 | 55 |
| | 75 | 1250 | 980 | 0.8 | 720 | — | 930 | 500 | 90 | −1 | 0.95 | 55 |
| | 76 | 1250 | 920 | 1.1 | — | 850 | — | 40 | 10 | 0 | 1.03 | 55 |
| | 77 | 1250 | 910 | 1.2 | — | — | 930 | 20 | 5 | 0 | 0.98 | 55 |
| Comparative | 78 | 1250 | 930 | 0.85 | 680 | — | — | 200 | 80 | 0 | 0.84 | 71 |
| | 79 | 1250 | 930 | 0.85 | 680 | — | — | 200 | 75 | 0 | 0.55 | 70 |
| | 80 | 1250 | 930 | 0.85 | 680 | — | — | 200 | 80 | 5 | 0.53 | 53 |

EXAMPLE 10

Electrical steel heavy plate having the compositions listed in Table 17 were produced using the conditions listed in Table 18.

Inventive steels 81 to 87, which each had coarse, uniform grains, exhibited good tensile strength and magnetic properties.

Comparative steel 88 showed low tensile strength owing to a titanium content that was too low. Comparative steels 89, with high titanium, 90, with high aluminum, each showed poor magnetic properties.

TABLE 17

| | Steel No. | (wt %) C | Si | Mn | P | S | Cr | Mo | Cu | Ti | Al | N | O | H |
|---|---|---|---|---|---|---|---|---|---|---|---|---|---|---|
| Invention | 81 | 0.007 | 0.01 | 0.15 | 0.008 | 0.004 | 0.03 | 0.009 | 0.01 | 0.10 | 0.010 | 0.002 | 0.004 | 0.00006 |
| | 82 | 0.007 | 0.01 | 0.13 | 0.005 | 0.003 | 0.03 | 0.008 | 0.01 | 0.10 | 0.002 | 0.003 | 0.004 | 0.00007 |
| | 83 | 0.008 | 0.02 | 0.14 | 0.005 | 0.008 | 0.04 | 0.007 | 0.01 | 0.12 | 0.030 | 0.002 | 0.004 | 0.00006 |
| | 84 | 0.008 | 0.02 | 0.14 | 0.005 | 0.008 | 0.04 | 0.007 | 0.01 | 0.13 | 0.030 | 0.002 | 0.004 | 0.00006 |
| | 85 | 0.008 | 0.02 | 0.14 | 0.005 | 0.008 | 0.04 | 0.007 | 0.01 | 0.08 | 0.030 | 0.002 | 0.004 | 0.00006 |
| | 86 | 0.006 | 0.01 | 0.17 | 0.007 | 0.003 | 0.02 | 0.009 | 0.01 | 0.10 | 0.032 | 0.003 | 0.003 | 0.00008 |

TABLE 17-continued

| | Steel No. | (wt %) C | Si | Mn | P | S | Cr | Mo | Cu | Ti | Al | N | O | H |
|---|---|---|---|---|---|---|---|---|---|---|---|---|---|---|
| | 87 | 0.007 | 0.01 | 0.15 | 0.009 | 0.005 | 0.04 | 0.008 | 0.01 | 0.18 | 0.025 | 0.003 | 0.002 | 0.00011 |
| Comparative | 88 | 0.007 | 0.01 | 0.12 | 0.010 | 0.002 | 0.03 | 0.005 | 0.01 | 0.03 | 0.021 | 0.003 | 0.003 | 0.00007 |
| | 89 | 0.007 | 0.01 | 0.10 | 0.011 | 0.002 | 0.03 | 0.004 | 0.01 | 0.25 | 0.023 | 0.003 | 0.003 | 0.00008 |
| | 90 | 0.009 | 0.01 | 0.15 | 0.013 | 0.003 | 0.04 | 0.006 | 0.01 | 0.12 | 0.060 | 0.003 | 0.003 | 0.00005 |

TABLE 18

| | Steel No. | Heating Temp. (°C.) | Finish Rolling Temp. (°C.) | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Tensile Strength (kgf/mm²) | Magnetic Flux Density (at 80A/m) (tesla) |
|---|---|---|---|---|---|---|---|---|---|---|---|---|
| Invention | 81 | 1150 | 940 | 0.9 | 700 | — | — | 100 | 25 | −1 | 48.8 | 1.10 |
| | 82 | 1150 | 940 | 0.9 | 700 | — | — | 100 | 20 | −3 | 49.1 | 1.30 |
| | 83 | 1250 | 980 | 0.8 | 720 | — | — | 500 | 90 | −1 | 51.3 | 0.90 |
| | 84 | 1250 | 980 | 0.8 | 720 | 850 | — | 500 | 90 | −1 | 52.5 | 0.95 |
| | 85 | 1250 | 980 | 0.8 | 720 | — | 930 | 500 | 90 | −1 | 46.3 | 0.92 |
| | 86 | 1250 | 920 | 1.1 | — | 850 | — | 40 | 10 | 0 | 48.8 | 1.00 |
| | 87 | 1250 | 910 | 1.2 | — | — | 930 | 20 | 5 | 0 | 58.8 | 0.95 |
| Comparative | 88 | 1250 | 930 | 0.85 | 680 | — | — | 200 | 80 | 0 | 37.1 | 0.85 |
| | 89 | 1250 | 930 | 0.85 | 680 | — | — | 200 | 80 | 0 | 62.1 | 0.45 |
| | 90 | 1250 | 930 | 0.85 | 680 | — | — | 200 | 80 | 5 | 51.3 | 0.50 |

We claim:

1. A method of producing non-oriented magnetic steel heavy plate having high magnetic flux density comprising the steps of:

preparing a steel slab comprising, by weight, up to 0.01 percent carbon, up to 0.20 percent manganese, up to 0.015 percent phosphorus, up to 0.010 percent sulfur, up to 0.05 percent chromium, up to 2.0 percent nickel, up to 0.01 percent molybdenum, up to 0.01 percent copper, up to 0.004 percent nitrogen, up to 0.005 percent oxygen and up to 0.0002 percent hydrogen, and one or more deoxidizing agents selected from a group consisting of up to 4.0 percent silicon, up to 0.20 percent titanium, 0.005 to 0.40 percent aluminum, and up to 0.01 percent calcium, with the remainder being substantially iron;

heating the slab to a temperature of 1150° to 1350° C.;

carrying out at least one hot-rolling at a shape ratio A of at least 0.7 at a finish rolling temperature of at least 900° C.;

applying dehydrogenation heat treatment at between 600° and 750° C. for heavy plate with a gage thickness of 50 mm or more;

annealing at a temperature of 700° to 950° C. or normalizing at a temperature of 910° to 1000° C., as required;

annealing at a temperature of 750° to 950° C. or normalizing at a temperature of 910° to 1000° C. for hot-rolled heavy plate having a gage thickness that is at least 20 mm but less than 50 mm;

whereby a magnetic flux density of 0.8 tesla or more at a magnetic field of 80 A/m is imparted to the steel;

wherein the hot rolling is accomplished using a rolling roll having a radius R (mm) and wherein the steel heavy plate has an entry-side thickness $h_1$ (mm) and an exit-side plate thickness $h_0$ (mm) which exhibit a relationship with rolled shape ratio A of the hot rolling as follows:

$$A = 2\sqrt{R(h_1 - h_0)}\ /(h_1 + h_0).$$

2. The method according to claim 1 that includes the step of preparing a steel slab comprising, by weight, up to 0.01 percent carbon, up to 0.02 percent silicon, up to 0.20 percent manganese, up to 0.015 percent phosphorus, up to 0.010 percent sulfur, up to 0.05 percent chromium, up to 0.01 percent molybdenum, up to 0.01 percent copper, 0.005 to 0.40 percent aluminum, up to 0.004 percent nitrogen, up to 0.005 percent oxygen and up to 0.0002 percent hydrogen, with the remainder being substantially iron.

3. The method according to claim 1 that includes the step of cold-rolling at a reduction ratio of between 5 and 25 percent, prior to the annealing.

4. The method according to claim 1 that includes the steps of heating the slab to a temperature of 1200° to 1350° C. and hot-rolling with a finishing temperature in the ferrite zone at or below the $Ar_3$ transformation point.

5. The method according to claim 2 wherein the composition of the steel contains 0.1 to 1.0 percent silicon and up to 0.005 percent aluminum.

6. The method according to claim 2 wherein the composition of the steel contains 0.005 to 0.03 percent titanium and up to 0.005 percent aluminum.

7. The method according to claim 2 wherein the composition of the steel contains 0.0005 to 0.01 percent calcium and up to 0.005 percent aluminum.

8. The method according to claim 2 wherein the composition of the steel contains 0.005 to 0.03 percent titanium, 0.0005 to 0.01 percent calcium and up to 0.005 percent aluminum.

9. The method according to claim 2 wherein the composition of the steel contains 1.0 to 4.0 percent silicon and up to 0.040 percent aluminum.

10. The method according to claim 2 wherein the composition of the steel contains 0.01 to 2.0 percent nickel.

11. The method according to claim 2 wherein the composition of the steel contains 0.04 to 0.20 percent titanium and up to 0.040 percent aluminum.

* * * * *